US005445390A

United States Patent [19]

Dutton et al.

[11] Patent Number: 5,445,390

[45] Date of Patent: Aug. 29, 1995

[54] MATHEMATICAL BOARD GAME APPARATUS

[76] Inventors: Kris R. Dutton, 22721 NE. Halsey, #109 N., Troutdale, Oreg. 97060; Linda C. Rothlisberger, 1460 N. 62nd St., Mesa, Ariz. 85205

[21] Appl. No.: 368,025

[22] Filed: Jan. 3, 1995

[51] Int. Cl.[6] ..... A63F 3/00

[52] U.S. Cl. ..... 273/243; 273/272

[58] Field of Search ..... 273/242, 243, 248, 249, 273/272; 434/128, 129

[56] References Cited

U.S. PATENT DOCUMENTS

| | | | |
|---|---|---|---|
| 3,869,124 | 3/1975 | Stein et al. . | |
| 4,126,315 | 11/1978 | Tung | 273/271 |
| 4,219,196 | 8/1980 | DeCanto et al. | 273/126 |
| 4,360,347 | 11/1982 | Ghaznavi | 273/272 X |
| 4,565,374 | 1/1986 | Pak | 273/272 |
| 4,565,374 | 1/1986 | Pak | 273/272 |
| 4,940,240 | 7/1990 | Braley | 273/272 X |
| 5,083,793 | 1/1992 | Sanford | 273/272 X |
| 5,116,062 | 5/1992 | Johnson | 273/260 |
| 5,176,381 | 1/1993 | Winters | 273/272 X |
| 5,314,190 | 5/1994 | Lyons | 273/272 |
| 5,338,203 | 8/1994 | Rheams | 273/272 X |

FOREIGN PATENT DOCUMENTS

| | | | |
|---|---|---|---|
| 2658428 | 8/1991 | France | 273/272 |

*Primary Examiner*—William E. Stoll

*Attorney, Agent, or Firm*—David L. Baker; Rhodes & Ascolillo

[57] ABSTRACT

A mathematical Board Game for a plurality of players has a rectangular game board with a plurality of card stations or chambers arranged in a matrix of horizontal and vertical rows. The card chambers include a start card chamber in each corner of the board and a plurality of problem card chambers in a perimeter of the board between the start card chambers. A plurality of answer card chambers on the board are surrounded by the start card chambers and the problem card chambers. A start card is removably placed in each of the start card chambers. A problem card is removably placed in each one the problem card chambers. There is a different mathematical problem on each problem card. An answer card is removably placed in each one the answer card chambers. There is an answer to one of the mathematical problems on each of the answer cards. A plurality of position tokens is removably and selectively placed on the start cards and on the problem cards to assist the players in keeping track of their and other player's moves. A set of dice are thrown and placed on the board to randomly select which player of the plurality of players will move one of the position tokens before another player moves another one of the other position tokens. Each player takes his or her turn in that order until the game is finished.

17 Claims, 3 Drawing Sheets

MATHEMATICAL BOARD GAME APPARATUS

BACKGROUND OF THE INVENTION

1. Field of the Invention

This invention relates to an educational and instructional game to teach mathematics to children and to provide a game to entertain children and young adults while competing against one another in a mathematical skills contest.

2. Description of the Related Art

Learning to solve mathematical problems has never been high on most children's list of fun things to do. Parents face a problem of how to enhance the education of their children especially in the field of mathematics. Many math games are far too involved and difficult and the children are overwhelmed and loose interest quickly. Also once most games are played several times, the answers are known and the novelty wears out quickly. In addition, most games are not easily played by the sight impaired since the positions of play must be seen.

U.S. Pat. No. 3,869,124 to R.W. Stein, et al., on Mar. 4, 1975 for a Mathematical Board Game Apparatus shows a game wherein the players move to squares that are an integer multiple of the number on the piece. A piece may be captured when a piece lands on an opponents square or the opponent lands on a square that is not an integer multiple of the opponents playing piece.

U.S. Pat. No. 4,126,315 to C.K. Tung on Nov. 21, 1978 for a Mathematical Based Board Game Apparatus describes a game of offensive and defensive strategies and has different transparent game board matrix overlays illustrating paths of movement.

U.S. Pat. No. 4,219,196 to J.F. DeCanto, et al., on Aug. 26, 1980 for a Mathematical Game Board Apparatus shows a rectangular upper playing surface with a plurality of holes through which show various numbers when a lower board is rotated. Mathematical functions are performed upon the numbers shown as indicated.

U.S. Pat. No. 4,565,374 to K.H. Pak on Jan. 21, 1986 for a Mathematical Board Game Apparatus describes a board having a grid of squares in horizontal and vertical rows. Tiles are placed on the grid to gain sums divisible by ten.

U.S. Pat. No. 5,116,062 to P.M. Johnson on May 26, 1992 for a Game Apparatus and method of Playing shows a gridwork of alternating playing and non-playing squares. Each player has one set of + and − numbers up to number twelve and one set of numbers with no + and − indicators on them. The game is played like checkers with extra points for performing the mathematical functions indicated.

The present invention solves these problems by offering a mathematical board game that may have several sets of cards displaying increasing levels of problem difficulty. As the children advance, a different set of problem and answer cards may be substituted. This allows the game to continue to be challenging even into adulthood yet not daunting to the beginning child who starts with a fairly simple set of problems. For variety, several sets of problems for each level of learning may be supplied. The board game and card sets may be supplied with braille characters and depressions on the cards to assist the sight impaired in playing and learning.

SUMMARY OF THE INVENTION

This mathematical board game, often referred to as the "Match and Move Math" board game, is both educational and fun. Mathematical problem solving often intimidates people. This game provides children, young adults and even late learning adults a chance at solving math problems without the pressure of a school environment. It may even allow the players to look at math problem solving as something enjoyable.

The game is generally played by two to four players but may be played by more if teams are selected. The board is placed on a playing surface and the start, problem and answer cards placed in their appropriate places. A pair of dice is rolled to determine the sequence of play by the players and each player selects a token to represent them. The start cards, each a different color, are located in each corner of the rectangular board. The problem cards are placed in perimeter rows between the start cards. The answer cards, answer side down, fill up the remaining places in the center of the board. A player advances to the first problem card with his or her token and attempts to solve the problem displayed on that card. An answer card is selected (since the answer on the card is unknown because the answer side of the card is turned down, an element of chance is also provided) and a referee or one of the players checks an answer sheet to determine if the answer on the card is the correct solution to the problem. If it is, the player advances to the next problem card in his line of play. If the answer is wrong, the play passes to the next player. The goal may be that when a player reaches another player's start card, the game terminates or the players may agree to continue on around the board until a player is once more back to his or her own start card thus winning the game.

A set of cards may be provided for the sight impaired. These cards would have features that would allow the players to touch the cards and tokens and know the location of the card and their token and determine the problem asked and the answer provided on the answer card. Braille nodes may be placed on the cards.

The board may have chambers into which the cards are placed in order to keep the cards in position if they or the board are bumped. The chambers wherein the cards rest may have raised walls to aid in their location. The start cards and the problem cards may have slots or depressions to allow the players to place their tokens on the proper card more easily. The cards may all have one or more truncated (trimmed) corners to assist a player in picking up a card from a card chamber.

In one aspect of this invention, a mathematical Board Game for a plurality of players is shown that has a rectangular game board. The game board has a plurality of card stations arranged in a matrix of horizontal and vertical rows similar to the arrangement of a checkerboard. But the similarities end there. The plurality of card stations include a start card station in each corner of the board. There is a plurality of problem card stations in a perimeter of the board between the start card stations and a plurality of answer card stations on the board.

A start card is removably placed in each of the start card stations. There is a first indicia surface on each of the start cards. Each start card is a different color to identify where a particular player is to place his or her token to begin the game. A problem card removably placed in each one the problem card stations. There is a second indicia surface on each of the problem cards. A different mathematical problem is placed on the second indicia surface of each problem card. There is an answer card removably placed in each one the answer card stations. There is a third indicia surface on each of the answer cards. A mathematical answer to one of the mathematical problems, on the first indicia surface of one of the problem cards, is placed on the third indicia surface of one of the answer cards. The position tokens may be made in a form of an "M", an "A", a "T" and an "H".

A plurality of position tokens is removably and selectively placed on the start cards and on the problem cards (one token on each start card). A set of die are rollingly and removably placed on the board (or onto any other suitable surface) to randomly select which player of the plurality of players will move one of the position tokens before another player moves another one of the position tokens. Indicia may be placed on the first indicia surface to indicate on which start card a player should first place the position token to begin a game sequence. A computer program could be written to allow players to play this game on their personal computer.

Each start card may have raised braille nodes on the first indicia surface to aid the reading of the start cards by a blind player. Each problem card may have raised braille nodes on the second indicia surface to aid the reading of the mathematical problems, on the second indicia surface, by a blind player. Each answer card may have raised braille nodes on the third indicia surface to aid the reading of the mathematical answers, on the third indicia surface, by a blind player. Each start card may have a first depression to receive a position token to aid the location of the position token on the start card by a blind player. Each problem card may have a second depression to receive a position token to aid the location of the position token on the problem card by a blind player.

It is an object of this invention to provide a mathematical board game that will teach mathematical problem solving to children of all ages and provide many hours of educational fun.

DESCRIPTION OF THE PREFERRED EMBODIMENTS

Figure 1:
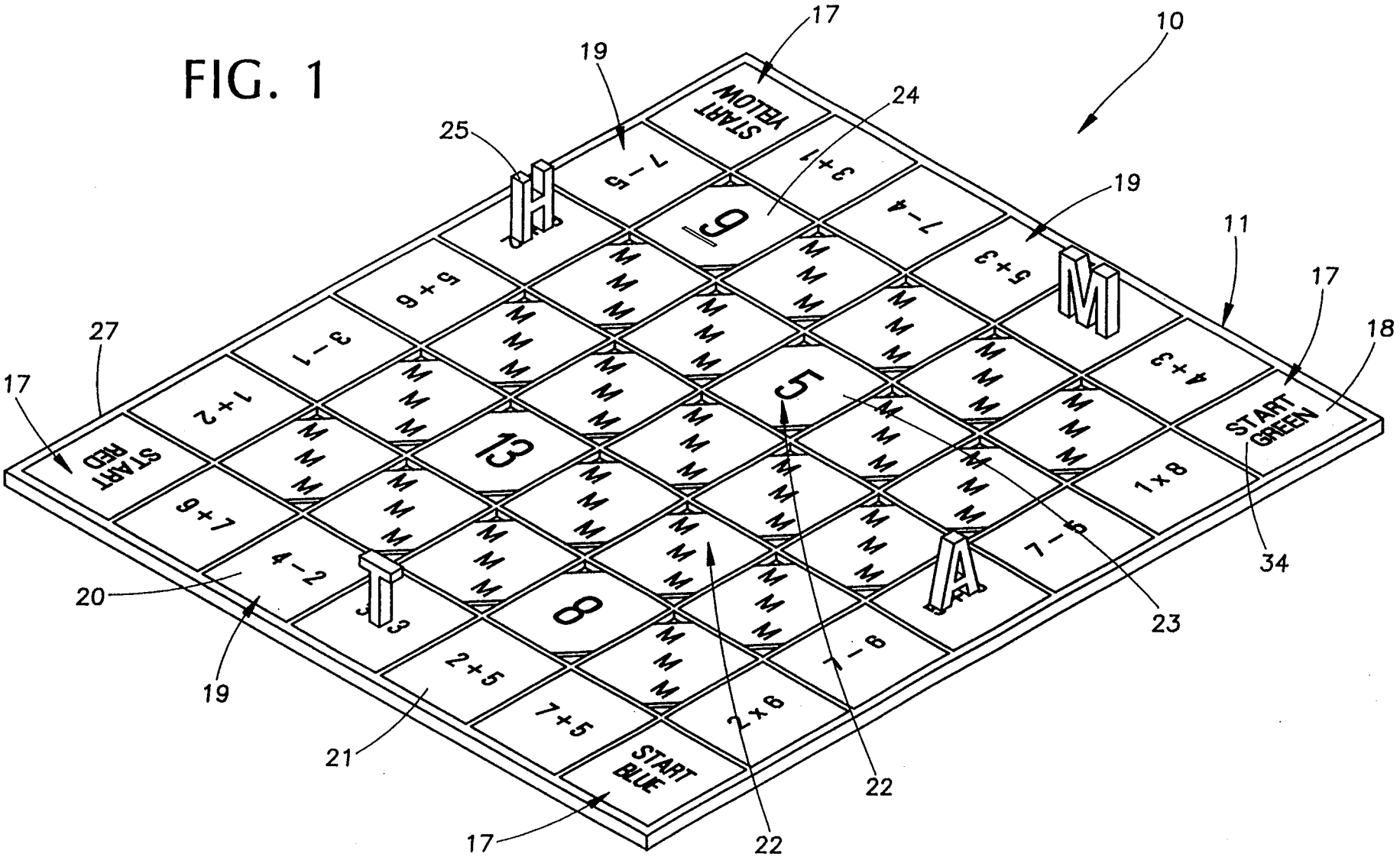
FIG. 1 is a top perspective view of the Mathematical Board Game shown with the position tokens on the board to indicate position.
Figure 2:
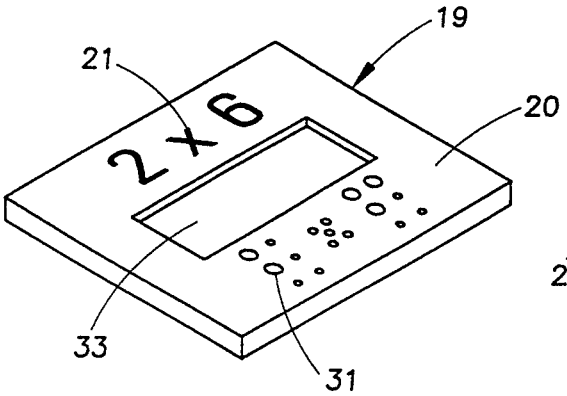
FIG. 2 is a top perspective view of a problem card.
Figure 3:
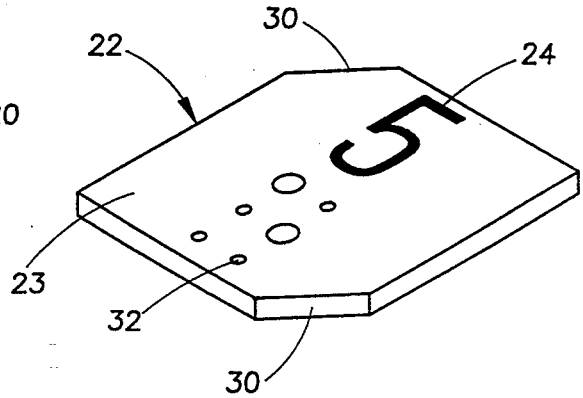
FIG. 3 is a top perspective view of an answer card.
Figure 4:
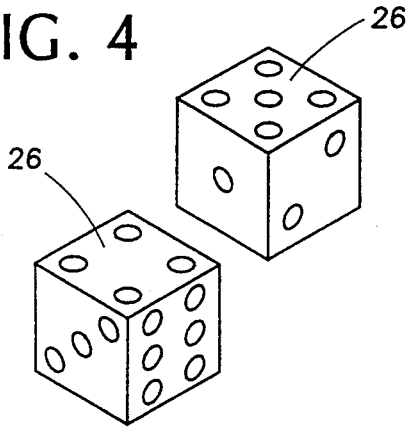
FIG. 4 is a perspective view of a set of dice used in the game.
Figure 5:
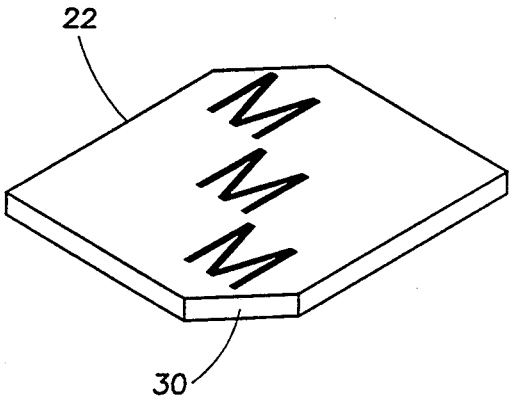
FIG. 5 is a bottom perspective view of an answer card.
Figure 6:
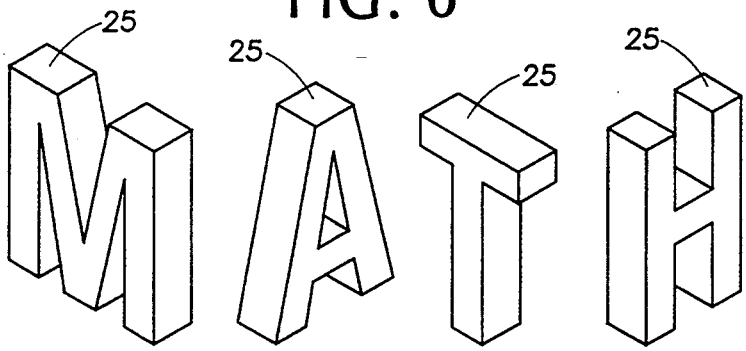
FIG. 6 is a top perspective view of the position tokens.
Figure 7:
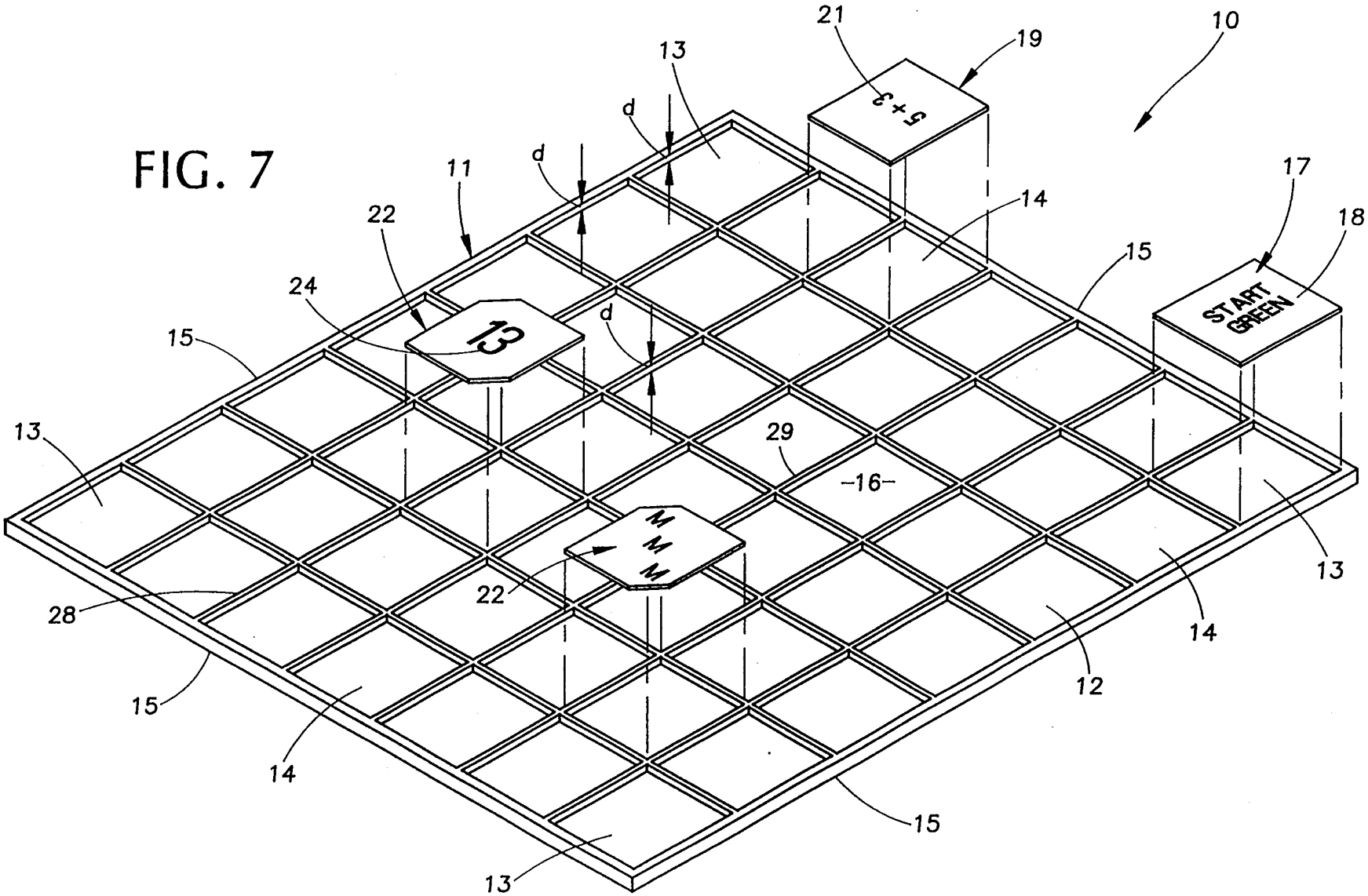
FIG. 7 is a top perspective view of the board showing the problem cards and the answer cards removed and showing some of the cards exploded from the board to indicate their replacability.

Referring to FIGS. 1 through 7, a mathematical Board Game 10 for a plurality of players is shown and described that has a rectangular game board 11. The rectangular game board 11 has a plurality of card chambers 12 arranged in a matrix of horizontal and vertical rows. The plurality of card chambers 12 includes a start card chamber 13 in each corner of the board 11. There is a plurality of problem card chambers 14 in a perimeter 15 of the board 11 between the start card chambers 13. There is also a plurality of answer card chambers 16 on the board 11 surrounded by the start card chambers 13 and the problem card chambers 14.

A start card 17 is removably placed in each of the start card chambers 13. There is one completely different start card 17 for each of the four start card chambers. There is a first indicia surface 18 on each of the start cards. Each start card 17 is a different color and preferably has the word "START" and the word for the color of the start card such as "RED", "YELLOW", "GREEN" or "BLUE" on the first indicia surface.

A problem card 19 is removably placed in each one of the problem card chambers 14. There is a second indicia surface 20 on the problem card 19. There is a mathematical problem 21 on the second indicia surface 20 of each problem card. Each problem card 19 has a different problem 21 on it. The problem cards may be arranged in the problem card chambers 14 in a random manner to add variety to the game. The players must determine what they feel is a correct answer to the problem shown on the problem card.

An answer card 22 is removably placed in each one of the answer card chambers 16. There is a third indicia surface 23 on the answer card. There is a mathematical answer 24, on the third indicia surface 23, to one of the mathematical problems 21 on the second indicia surface 20 of one of the problem cards 19. The answer cards 22 are placed in the answer card chambers 16 in a random manner to add variety to the game and the answer cards are placed in the answer card chambers with the answers 24 down toward the board 11 so that the players cannot see an answer before they select an answer card by chance. They then turn the answer card 22 over to see if they have chosen a card with the correct answer on it.

There is a plurality of position tokens 25 (preferably four) removably and selectively placed on the start cards 17 and on the problem cards 19 to assist the players in keeping track of their and other player's moves. A set of die 26 are rollingly and removably thrown and placed on the board 11 or other playing surface (not shown) to randomly select which player of the plurality of players :will move one of the position tokens 25 before another player moves another one of the other position tokens. Each player, after his or her turn in the sequence of play is determined by the die throw, takes his or her turn in that order.

Each start card chamber 13 may have a depth "d" so that a first wall perimeter 27 of the start card chambers extends higher than the start card 17 placed therein. Each problem card chamber 14 has a depth "d" so that a second wall perimeter 28 of the problem card chambers 14 extends higher than the problem card 19 placed therein and each answer card chamber 16 has a depth "d" so that a third wall perimeter 29 of the answer card chambers 16 extends higher than the answer card 22 placed therein. This enables a sight impaired or blind person to differentiate one chamber from another more easily. It also keeps the cards in place in a more orderly and manageable manner especially when tables and game boards are subject to constant bumping by eager children. Each answer card 22 may have at least one truncated (trimmed) corner 30 to make the task of lifting an answer card 22 out of a chamber 16 a bit easier.

A game 10 intended to be played by the sight impaired or blind may have each start card 17 have raised braille nodes (such as found on the problem and answer cards) on the first indicia surface 18 to aid the reading of the start cards. Each problem card 19 may have raised braille nodes 31 on the second indicia surface 20 to aid the reading of the mathematical problems 21, on the second indicia surface 20, by a blind player and each answer card 22 may have raised braille nodes 32 on the third indicia surface 23 to aid the reading of the mathematical answers 24, on the third indicia surface 23, by a blind player. A standard game board 10 could be purchased with a set of cards for the non-sight impaired and a set of cards for the sight impaired could be purchased separately if both sets were needed. Each start card 17 for the blind and sight impaired may have a first depression (such as that found in the problem cards) to receive a position token 25 to aid the location of the position token 25 on the start card 17 and each problem card 19 may have a second depression 33 to receive a position token 25 to aid the location of the position token on the problem card.

There may be indicia 34, on the first indicia surface, indicating on which start card a player should first place the position token to begin a game sequence. The position tokens 25 preferably include tokens in a form of an "M", an "A", a "T" and an "H".

The board 11 could be made from pressed fibrous material such as cardboard or wood or other suitable materials known in the art. The chambers 12 could be formed separately and adhered to a fiat board or could be molded or pressed at the same time the board is formed. The cards may be formed by known card manufacturing techniques and could be made of cardboard or plastic. The surfaces will be colored and printed by known methods. The cards having holes and braille nodes for the sight impaired may be cut and formed in another manufacturing step if desired. The tokens 25 may be made of plastic, metal or other suitable materials and formed by any suitable process such as molding or forging as desired.

A method of playing a mathematical Board Game, involving a plurality of players, is presented that includes the following steps including placing a rectangular game board 11 on a playing surface such as a table. The board is made having a plurality of card chambers 12 arranged in a matrix of horizontal and vertical rows. A card chamber 12 in each corner of the board is selected as a start card chamber 13. A plurality of the card chambers 12 in a perimeter of the board between the start card chambers 13 are selected as problem card chambers 14. The remaining plurality of the card chambers 12 on the board are selected as answer card chambers 16. A start card 17 is removably placed in each of the start card chambers 13. Each start card 17 has first indicia surface 18 placed on it. Each start card is made a different color. A problem card 19 is removingly placed in each one the problem card chambers 14. Each problem card has a second indicia surface 20 on it. A mathematical problem 21 is placed on the second indicia surface of each problem card. An answer card 22 is removably placed in each one of the answer card chambers 16. Each answer card has a third indicia surface 23 on it. A mathematical answer 24, to one of the mathematical problems 21 on the second indicia surface 20 of one of the problem cards 19, is placed on the third indicia surface 23. A plurality of position tokens 25 are removably and selectively placed on the start cards 17 and on the problem cards 19.

A set of die 26 are rollingly and removably placed on the board 11 or other suitable playing surface to randomly select which player of the plurality of players will move one of the position tokens 25 before another player moves another one of the position tokens. A goal is set in order to choose a winning player. All players have to place their token on a separate start card 17 that indicates where they are to start the game. A player has to advance a token 25 to a problem card 19. That player has to choose an answer card 22 from the selection of answer cards in the answer card chambers 16. The players or a referee must determine from an answer sheet (not shown) if an answer 24 on the answer card 22 chosen is the correct solution to the problem which the player has to answer.

If the answer is correct, the present player repeats steps listed in the claims as "r" through "t". If the answer on the answer card is wrong, the present player must allow another player to advance his or her token 25 to another problem card 19 in their line of advance among the problem cards and then allow the other player to repeat steps listed in the claims as "r" through "v". When the goal that was set is reached by a player, the players select a player as the winning player.

For sight impaired and blind players, the method of playing the game 10 may involve having raised braille nodes on the first indicia surface 18 of each start card 17 to aid the reading of the start cards. The method may also involve having raised braille nodes 31 on the second indicia surface 20 of each problem card 19 to aid the reading of the mathematical problems 21, on the second indicia surface 20, by a sight impaired or blind player. The method of playing the game 10 may include having raised braille nodes 32 on the third indicia surface 23 of each answer card 22 to aid the reading of the mathematical answers 24, on the third indicia surface 23, by a sight impaired or blind player. The method of playing the game may involve having a first depression (such as that found on the problem cards) on each start card 17 to receive a position token 25 to aid the location of the position token on the start card by a blind player and having a second depression on each problem card to receive a position token to aid the location of the position token on the problem card by a blind player. Indicia 34 is placed (either in print or braille), on the first indicia surface 18, indicating on which start card 17 a player should first place the position token 25 to begin a game sequence. Position tokens are used that have the form of an "M", an "A", a "T"; and an "H".

The foregoing descriptions and drawings of the invention are explanatory and illustrative only, and various changes in shape, sizes and arrangements of parts as well certain details of the illustrated construction may be made within the scope of the appended claims without departing from the true spirit of the invention.

We claim:

1. A mathematical Board Game for a plurality of players comprising:

(a) a rectangular game board having a plurality of card stations arranged in a matrix of horizontal and vertical rows;

(b) the plurality of card stations comprising:

a start card station in each corner of the board;

a plurality of problem card stations in a perimeter of the board between the start card stations; and a plurality of answer card stations on the board;

(c) a start card removably placed in each of the start card stations;

(d) a first indicia surface on the start card;

(e) each start card being of a different color;

(f) a problem card removably placed in each one the problem card stations;

(g) a second indicia surface on the problem card;

(h) a mathematical problem on the second indicia surface of each problem card;

(i) an answer card removably placed in each one of the answer card stations;

(j) a third indicia surface on the answer card;

(k) a mathematical answer, on the third indicia surface, to one of the mathematical problems on the second indicia surface of one of the problem cards;

(l) a plurality of position tokens removably and selectively placed on the start cards and on the problem cards; and (m) a set of dice to randomly select which player of the plurality of players will move one of the position tokens before another player moves another one of the position tokens.

2. A mathematical Board Game as described in claim 1 further comprising indicia, on the first indicia surface, indicating on which start card a player should first place the position token to begin a game sequence.

3. A mathematical Board Game as described in claim 1 further Comprising:

(a) each start card having raised braille nodes on the first indicia surface to aid the reading of the start cards by a blind player;

(b) each problem card having raised braille nodes on the second indicia surface to aid the reading of the mathematical problems, on the second indicia surface, by a blind player; and (c) each answer card having raised braille nodes on the third indicia surface to aid the reading of the mathematical answers, on the third indicia surface, by a blind player.

4. A mathematical Board Game as described in claim 1 wherein the position tokens further comprise:

(a) a token in a form of an M;

(b) a token in a form of an A;

(c) a token in a form of a T; and (d) a token in a form of an H.

5. A mathematical Board Game as described in claim 1 further comprising:

(a) each start card having a first depression to receive a position token to aid the location of the position token on the start card by a blind player; and (b) each problem card having a second depression to receive a position token to aid the location of the position token on the problem card by a blind player.

6. A mathematical Board Game for a plurality of players comprising:

(a) a rectangular game board having a plurality of card chambers arranged in a matrix of horizontal and vertical rows;

(b) the plurality of card chambers comprising:

a start card chamber in each corner of the board;

a plurality of problem card chambers in a perimeter of the board between the start card chambers; and a plurality of answer card chambers on the board;

(c) a start card removably placed in each of the start card chambers;

(d) a first indicia surface on the start card;

(e) each start card being of a different color;

(f) a problem card removably placed in each one the problem card chambers;

(g) a second indicia surface on the problem card;

(h) a mathematical problem on the second indicia surface of each problem card;

(i) an answer card removably placed in each one of the answer card chambers;

(j) a third indicia surface on the answer card;

(k) a mathematical answer, on the third indicia surface, to one of the mathematical problems on the second indicia surface of one of the problem cards;

(l) a plurality of position tokens removably and selectively placed on the start cards and on the problem cards; and (m) a set of dice to randomly select which player of the plurality of players will move one of the position tokens before another player moves another one of the position tokens.

7. A mathematical Board Game as described in claim 6 further comprising:

(a) each start card chamber having a depth so that a first wall perimeter of the start card chambers extends higher than the start card placed therein;

(b) each problem card chamber having a depth so that a second wall perimeter of the problem card chambers extends higher than the problem card placed therein; and (c) each answer card chamber having a depth so that a third wall perimeter of the answer card chambers extends higher than the answer card placed therein.

8. A mathematical Board Game as described in claim 6 further comprising each answer card having at least one truncated corner.

9. A mathematical Board Game as described in claim 6 further comprising:

(a) each start card having raised braille nodes on the first indicia surface to aid the reading of the start cards by a blind player;

(b) each problem card having raised braille nodes on the second indicia surface to aid the reading of the mathematical problems, on the second indicia surface, by a blind player; and (c) each answer card having raised braille nodes on the third indicia surface to aid the reading of the mathematical answers, on the third indicia surface, by a blind player.

10. A mathematical Board Game as described in claim 6 further comprising:

(a) each start card having a first depression to receive a position token to aid the location of the position token on the start card by a blind player; and (b) each problem card having a second depression to receive a position token to aid the location of the position token on the problem card by a blind player.

11. A mathematical Board Game as described in claim 6 further comprising indicia, on the first indicia surface, indicating on which start card a player should first place the position token to begin a game sequence.

12. A mathematical Board Game as described in claim 6 wherein the position tokens further comprise:

(a) a token in a form of an M;

(b) a token in a form of an A;

(c) a token in a form of a T; and (d) a token in a form of an H.

13. A method of playing a mathematical Board Game, involving a plurality of players, comprising the steps of:

(a) placing a rectangular game board having a plurality of card chambers arranged in a matrix of horizontal and vertical rows on a playing surface;

(b) selecting one of the card chambers in each corner of the board as a start card chamber;

(c) selecting a plurality of the card chambers in a perimeter of the board between the start card chambers as problem card chambers;

(d) selecting a remaining plurality of the card chambers on the board as answer card chambers;

(e) removably placing a start card in each of the start card chambers;

(f) having a first indicia surface on the start card;

(g) making each start card a different color;

(h) removingly placing a problem card in each one the problem card chambers;

(i) having a second indicia surface on the problem card;

(j) placing a mathematical problem on the second indicia surface of each problem card;

(k) removably placing an answer card in each one the answer card chambers;

(l) having a third indicia surface on the answer card;

(m) placing a mathematical answer, on the third indicia surface, to one of the mathematical problems on the second indicia surface of one of the problem cards;

(n) removably and selectively placing a plurality of position tokens on the start cards and on the problem cards;

(o) rolling a set of dice on the board to randomly select which player of the plurality of players will move one of the position tokens before another player moves another one of the position tokens;

(p) setting a goal in order to choose a winning player;

(q) having all players place a token on a separate start card;

(r) having a player advance the token to a problem card;

(s) choosing an answer card;

(t) determining if an answer on the answer card chosen is correct;

(u) if the answer is correct, repeat steps r through t;

(v) if the answer on the answer card is wrong, allowing another player to advance another token to another problem card and allowing the other player to repeat steps r through v; and (w) reaching of the goal by a player and selecting the player as the winning player.

14. A method of playing a mathematical Board Game as described in claim 13 further comprising the steps of:

(a) having raised braille nodes on the first indicia surface of each start card to aid the reading of the start cards by a blind player;

(b) having raised braille nodes on the second indicia surface of each problem card to aid the reading of the mathematical problems, on the second indicia surface, by a blind player; and (c) having raised braille nodes on the third indicia sur#ace of each answer card to aid the reading of the mathematical answers, on the third indicia surface, by a blind player.

15. A method of playing a mathematical Board. Game as described in claim 13 further comprising the steps of:

(a) having a first depression on each start card to receive a position token to aid the location of the position token on the start card by a blind player; and (b) having a second depression on each problem card to receive a position token to aid the location of the position token on the problem card by a blind player.

16. A method of playing a mathematical Board Game as described in claim 13 further comprising the steps of having indicia, on the first indicia surface, indicating on which start card a player should first place the position token to begin a game sequence.

17. A method of playing a mathematical Board Game as described in claim 13 wherein the step of placing the position tokens further comprise the steps of:

(a) using a token in a form of an M:

(b) using a token in a form of an A;

(c) using a token in a form of a T; and (d) using a token in a form of an H.

* * * * *